US005797176A

United States Patent [19]

Rose et al.

[11] Patent Number: 5,797,176

[45] Date of Patent: Aug. 25, 1998

[54] GOLF CLUB HEAD MANUFACTURING METHOD

[75] Inventors: Dave Rose, Cardiff; William A. Priest, Oceanside, both of Calif.

[73] Assignee: Taylor Made Golf Company, Inc., Carlsbad, Calif.

[21] Appl. No.: 591,298

[22] Filed: Jan. 25, 1996

[51] Int. Cl.[6] ..... B23P 17/00; B22D 19/06; B24B 13/00; A63B 53/08

[52] U.S. Cl. ..... 29/527.5; 29/527.6; 164/95; 164/397; 473/340; 473/341; 473/350; 473/251

[58] Field of Search ..... 473/341, 340, 473/349, 350, 251; 273/DIG. 12; 29/527.5, 527.6

[56] References Cited

U.S. PATENT DOCUMENTS

| | | | |
|---|---|---|---|
| D. 161,790 | 1/1951 | Sappington | D34/5 |
| D. 279,497 | 7/1985 | Brown | D21/219 |
| D. 300,443 | 3/1989 | Antonious | D21/217 |
| D. 300,444 | 3/1989 | Antonious | D21/217 |
| D. 360,444 | 7/1995 | Takahashi et al. | D21/219 |
| D. 368,751 | 4/1996 | Rife | D21/219 |
| 4,498,672 | 2/1985 | Bulla | 273/DIG. 12 |
| 4,655,459 | 4/1987 | Antonious | 273/171 |
| 4,798,384 | 1/1989 | Kobayashi | 473/349 |
| 4,824,115 | 4/1989 | Walther | 273/169 |
| 5,016,883 | 5/1991 | Kobayashi | 473/349 X |
| 5,131,656 | 7/1992 | Kinoshita | 473/341 |
| 5,246,231 | 9/1993 | Antonious | 273/167 F |
| 5,340,107 | 8/1994 | Baker et al. | 273/167 R |
| 5,344,140 | 9/1994 | Anderson | 273/78 |
| 5,417,419 | 5/1995 | Anderson | 273/78 |
| 5,482,281 | 1/1996 | Anderson | 273/169 |

FOREIGN PATENT DOCUMENTS

| | | |
|---|---|---|
| 2195086 | 3/1988 | United Kingdom . |
| 2297916 | 8/1996 | United Kingdom . |

*Primary Examiner*—George J. Marlo
*Attorney, Agent, or Firm*—Greenblum & Bernstein, P.L.C.

[57] ABSTRACT

The invention is directed to a golf club head and, more specifically, to a putter. In addition, the invention is directed to a method of manufacturing a golf club head. The putter head includes a first body element made of a high density first material, constituting at least the heel portion, the toe portion and a major portion of the surface of the sole, and a second body element intimately linked to the first element, the second element being made of a second metallic material of lower density, the second element covering the remainder of the head including at least the central portion of the striking face thereof. The method includes the shaping of a first element by forging of a rough shaped piece in a metallic material, the arrangement of the first element in a mold creating a free space between the surfaces of the first element and the walls of the cast; the casting of the second element in intimate connection with the first element by injection or pouring of the second material into the volume of the free space; and, after the solidification in place of the second head, the removal of the head from the mold.

24 Claims, 5 Drawing Sheets

Fig- 4
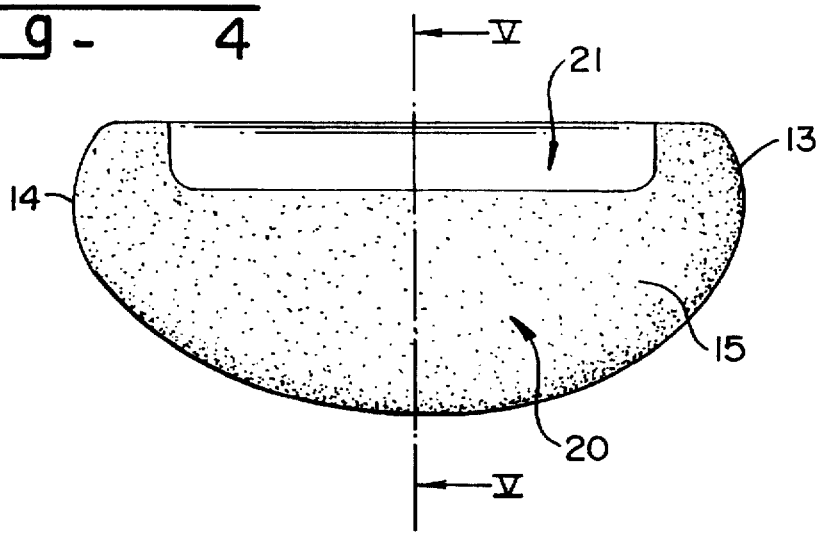
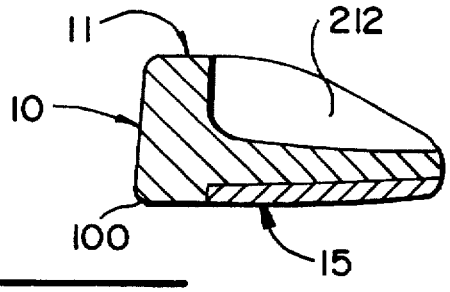
Fig- 5
Fig- 6
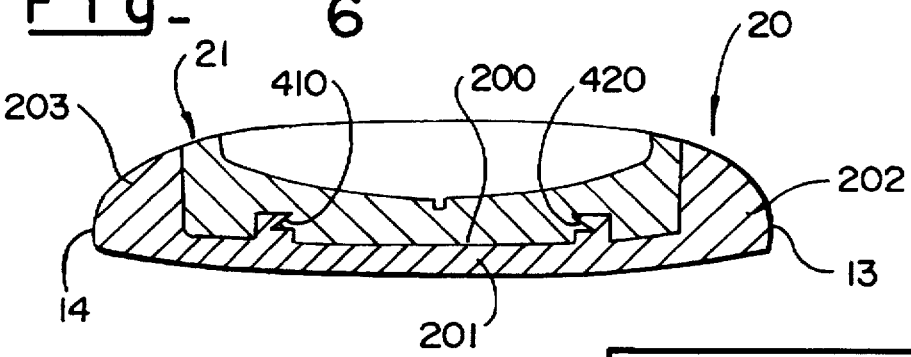
Fig- 7
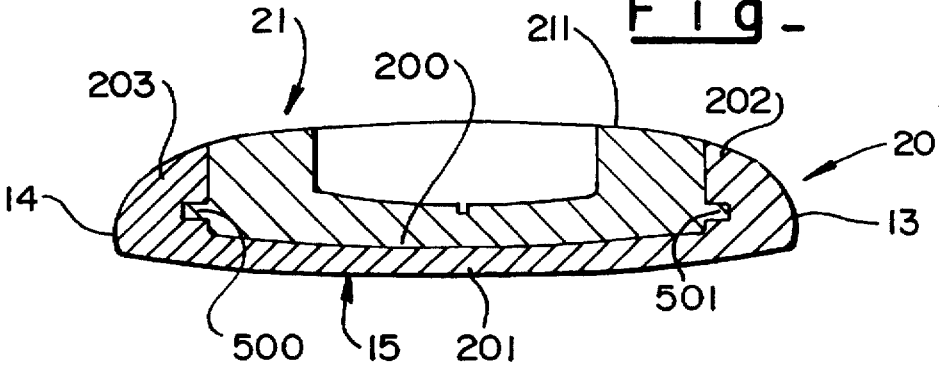

GOLF CLUB HEAD MANUFACTURING METHOD

BACKGROUND OF THE INVENTION

1. Field of the Invention

The invention is related in a general manner to the field of golf, and more particularly to a golf putter head of improved construction as well as to an improved method of manufacturing.

2. Description of Background and Relevant Information

The head of a putter generally has the shape of an elongated mass that includes a striking face arranged substantially perpendicular to the horizontal or ground, which is used to strike the ball and cause it to roll on the green in an attempt to move it closer to the hole or, even better, into the hole.

It is recognized that off-centered strokes tend to cause a rotation of the face with respect to a starting position perpendicular to the intended trajectory. To reduce this twisting effect, an attempt has been made to construct heads by distributing the mass towards the ends of the heel and toe so as to increase the resistance to rotation by an increase of inertia. The constructions known from the prior art, however, are not completely satisfactory. In the case of heads made out of one single amorphous material as in U.S. Pat. No. 5,246,231, for example, heavy materials, such as brass, copper, or even cupro-beryllium, are generally chosen, and the volume of the toe and heel material is increased with respect to the center face. The sensation upon impact on materials of high density is not very agreeable and it is very difficult to control the intensity and length of the stroke.

More sophisticated constructions call for light metallic or plastic structures extending at the ends by cavities filled with a metal of high density in the form of inserts, of screwed or affixed weights, or even steel balls, agglomerated powder, etc. U.S. Pat. Nos. 4,655,459 and 5,340,107 are some examples among many others of such embodiments. The mass distribution is, however, not optimum for both reducing the tendency for rotation of the head and promoting the top spin to cause the ball to roll and to control the trajectory and length of the ball.

SUMMARY OF THE INVENTION

The object of the present invention is to propose a new construction of a head with optimized mass distribution that resists the twisting effect during off-centered strokes and gains a top spin effect by a meshing/gearing effect that improves the rolling of the ball and therefore improves the control thereof.

Another object is to give the club head an impact sensation that is both soft and solid by choosing an appropriate material that is different from than that used to principally distribute the mass.

For this, the invention relates to a putter head that includes:

(a) a first body element made of a first metallic material of high density constituting at least the heel portion, the toe portion, and a major portion of the surface of the sole;

(b) a second body element intimately connected to the first element made of a second metallic material of low density covering the remainder of the head, including at least the central portion of the striking face.

From this specific assembly of two elements made of materials having different densities, one promotes an optimal heel/toe distribution of mass by increasing the moment of inertia of the head and by reducing the twisting effect, and one also lowers the center of gravity of the head to promote the top spin effect on the ball. In addition, one improves the sensations during impact due to the second element made of a material that is both solid and soft.

More precisely, according to the invention:

(a) the first element has a U-shaped cavity with a base forming a major portion of the sole, which is laterally extended by two wings extending upward and rearward forming the heel portion and toe portion, respectively;

(b) the second element has a shape complementary to the shape of the cavity of the first element, including a front portion constituting the major portion of the face, and which extends toward the rear by a central portion and which is positioned in the cavity of the first element.

The first element manages the mass distribution by reason of its U-shape. The second element made out of a suited material ensures the restitution of touching sensations with the ball. According to a complementary characteristic, the first element is made as one single piece in the course of a single operation by the forging technique, and the second element is a piece cast in place in the cavity of the first element.

The invention also relates to a method of manufacturing a bi-material putter that includes:

(a) the shaping of a first element by forging a rough piece in a first metallic material;

(b) the arrangement of this first element in a cast by creating a free space between the surfaces of the first element and the walls of the cast;

(c) the casting of the second element in intimate connection with the first element by injection or pouring of a second material into the volume of the free space.

The assembly thus forms a homogenous and perfectly solid block. This assembly technique is economical and offers large possibilities for embodying original distinctive forms. It allows the production of heads in large series without a manual assembly operation.

According to a complementary characteristic, step (a) includes the formation of an open cavity in the first element into which at least one portion of the second element is poured or injected during step (c).

BRIEF DESCRIPTION OF THE DRAWINGS

Other characteristics and advantages of the invention will be better understood with the help of the description that follows and with reference to the annexed drawings.

FIG. 4 is a bottom view of the head of FIG. 1;

FIG. 5 is a cross sectional view taken along line V—V of the head of FIG. 4;

FIG. 6 is a cross-sectional view taken along line VI—VI of FIG. 2;

FIG. 7 is a cross-sectional view along line VII—VII of FIG. 2;

DETAILED DESCRIPTION OF THE PREFERRED EMBODIMENTS

Figure 1:
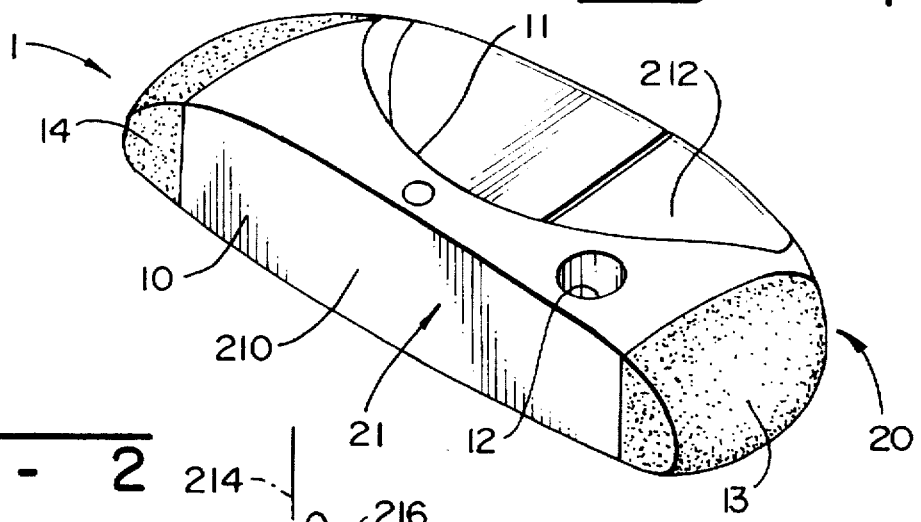
FIG. 1 is a perspective view of the putter head according to the invention.

The putter head according to the invention, as shown in FIGS. 1–5, has a body 1 having a portion of a substantially vertical striking surface 10, a front or top portion 11 in which a hole 12 is provided for the insertion of a shaft, a heel portion 13, an opposite toe portion 14 and a sole portion 15. According to one aspect of the invention, the head is constituted by an assembly of two distinct elements, a first element 20 of the body formed of a first metallic material of high density and a second element 21 of the body formed of a second metallic material that has a lower density than the first material.

The first element 20 forms the heel 13 and toe 14 portions as well as a major portion of the surface of sole 15. The second element forms the remainder of the body with the major portion of the striking surface 10 and a central portion of the top portion 11 of the head.

As shown in the cross-sections of FIGS. 6 or 7, the first element 20 has a cavity 200 with a general U-shape that defines a substantially horizontal elongated base 201 forming a portion of the sole 15 and that is laterally extended by two wings 202, 203 extending upwardly and rearwardly from the face 10 and forming the heel 13 and toe 14 portions, respectively, of the head.

From this particular geometry, the mass distribution is thus favored in the heel/toe to procure a substantial moment of inertia with respect to the vertical axis passing through the center of gravity and a distribution on the sole to lower the center of gravity to the maximum.

The second element 21 has a shape complementary to the first element 20 with a front portion 210 that occupies the face portion 10 on its entire height and a large portion of the width of the face that substantially corresponds to the distance separating the two wings 202, 203 of the first element and extends toward the rear by a central portion 211 that is positioned in the U-shaped cavity 200 of the first element. The attack or lead edge 100 of the face is therefore constituted by the material of the face that must have a substantial hardness to be capable of resisting scratches against the ground.

Figure 2:
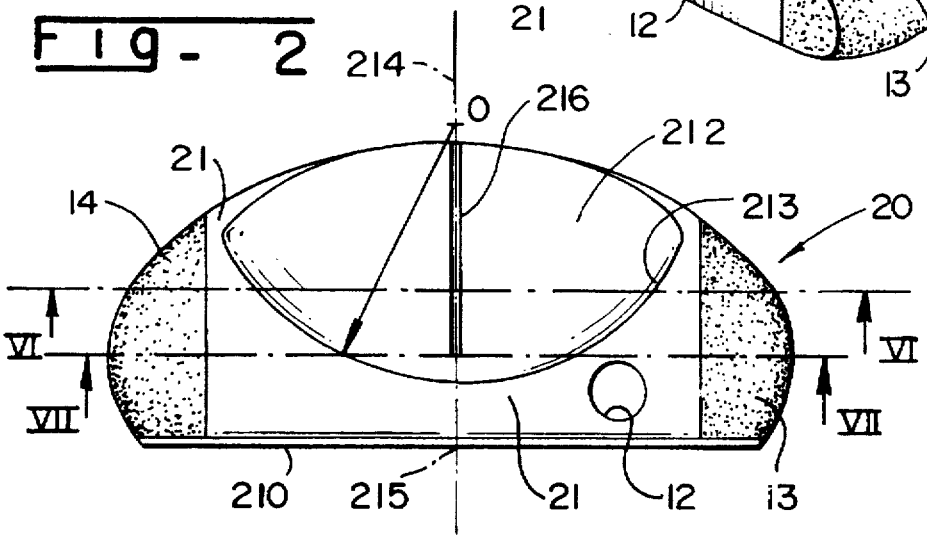
FIG. 2 is a top view of the head of FIG. 1.

As shown in FIGS. 1 and 2, the central portion 211 includes a recess 212 that is open toward the top and toward the rear in such a way as to create a reduction of thickness of the material in the central portion. This also favors the lowering of the center of gravity but also serves to help alignment by reason of its shape. More precisely, the recess 212 has an edge 213 having a curved shape in which the concavity is directed toward the front in the direction of the face 10. The edge 213 is a portion of an arc that has a radius R whose origin O is aligned along a line 214 perpendicular to the plane of the face and passing through the face center 215. The value of the radius R is substantially equivalent to that of the radius of the hole on the green.

It should be noted that the alignment system can be improved by providing a recessed or raised rectilinear marking 216 along the end of the recess 212 and merging with line 214.

For evident reasons of fabrication simplicity, the head has a perfect symmetry with respect to the median vertical plane P passing through the face center 215. One can thus use the same fabrication tools for putters intended for left-handed or right-handed players. The only change between a left-handed or right-handed arises from the positioning of the hole 12 that is necessary to provide on either side of plane P.

Figure 3:
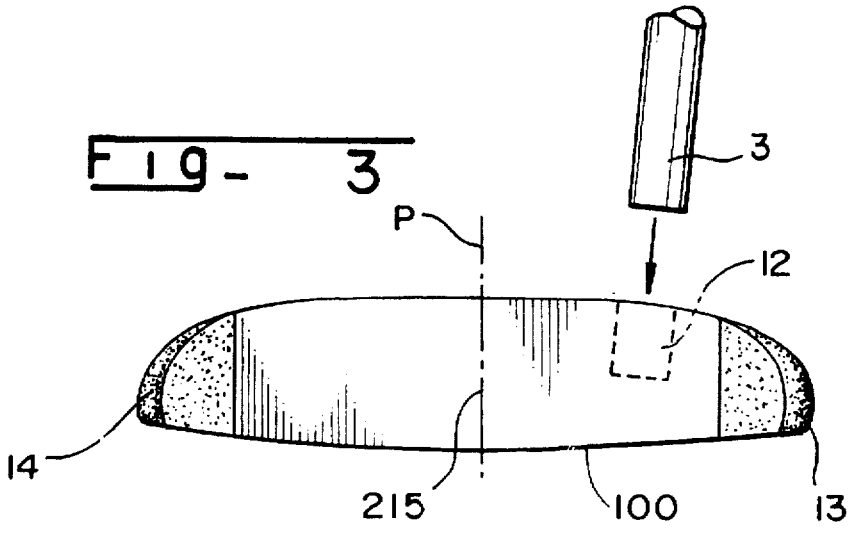
FIG. 3 is a front view of the head of FIG. 1 during the mounting of the shaft.

FIG. 3 shows the adaptation of the end of a shaft 3 in the hole 12 provided for this purpose to complete the assembly of the putter, the shaft having an appropriate grip applied thereto. The assembly is achieved by means of a rapid crosslinking glue, for example.

The material constituting the first element 20 is preferably chosen among copper or a copper-rich alloy for its high density in the vicinity of 8.85 and its good workability necessary for the implementation of the forging technique.

Other materials, however, such as tungsten, brass, or berylium-copper can be used.

The material comprising the second element 21 is preferably chosen among aluminum or aluminum-rich alloy for its lightness (density about 2.7 g/cm$^3$) and its good castability. Aluminum 6061 is preferred in the scope of the preferred embodiment. In the same manner, one can envision the use of another material of low density such as titanium, berylium, or magnesium.

The invention likewise is related to the method for manufacturing the putter head, and putter, adapted in particular to the type of construction just described.

Figure 8:
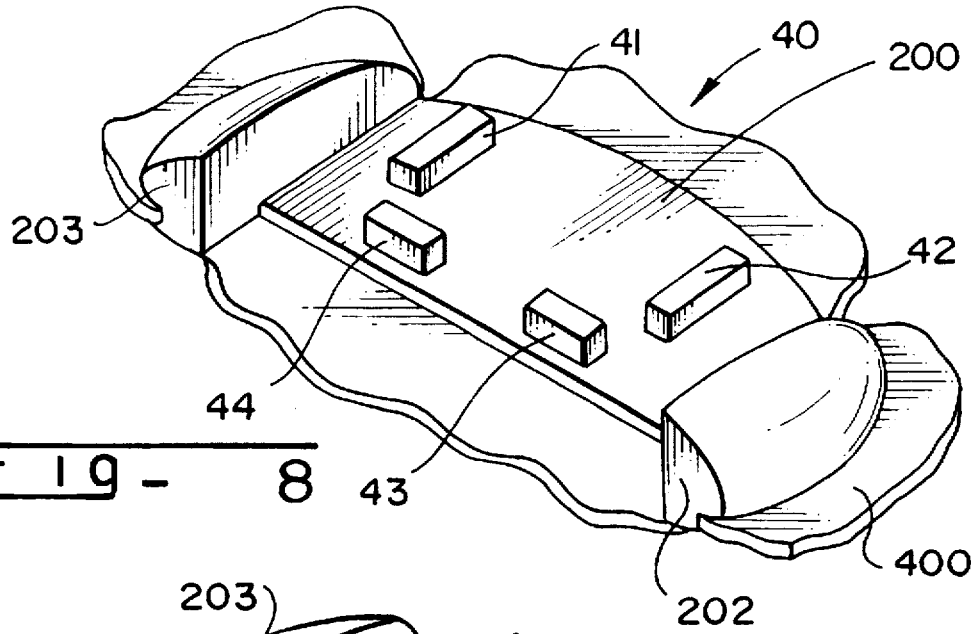
FIG. 8 shows the rough piece of one of the elements of the head after forging according to the manufacturing method of the invention.

This method is illustrated by FIGS. 8–13. It first includes the formation of the first element by forging of a rough shaped piece 40 as shown in FIG. 8. One thus hot forges in a mold, in the course of a single phase, the element with its cavity 200 edged with flanges or wings 202, 203. During this step, a plurality of raised securing or connection elements 41, 42, 43, 44 are formed in the bottom of the cavity, unitary with the first element such securing element being adapted to improve the anchoring of the second element to the first to subsequently form an assembly or intimately solid body.

Figure 9:
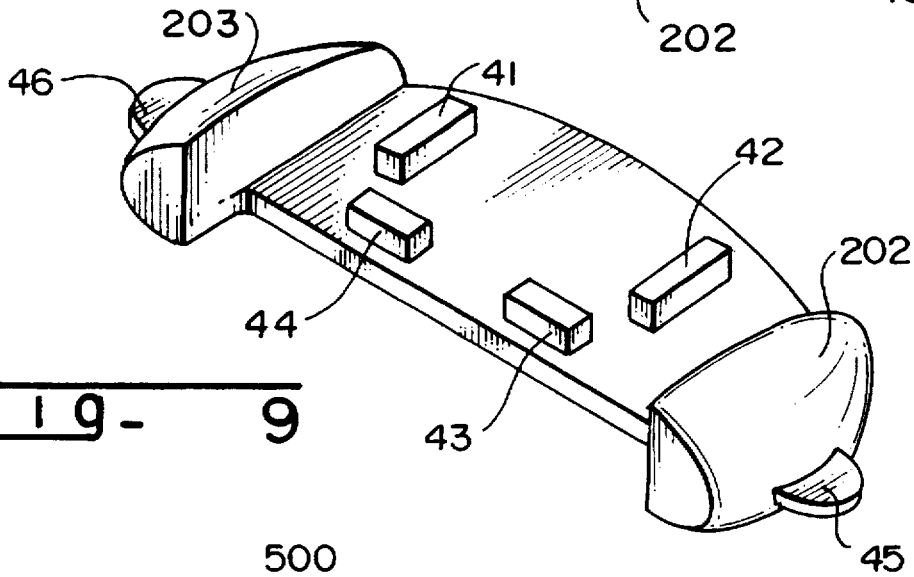
FIG. 9 shows the rough piece of FIG. 8 after deburring.
Figure 10:
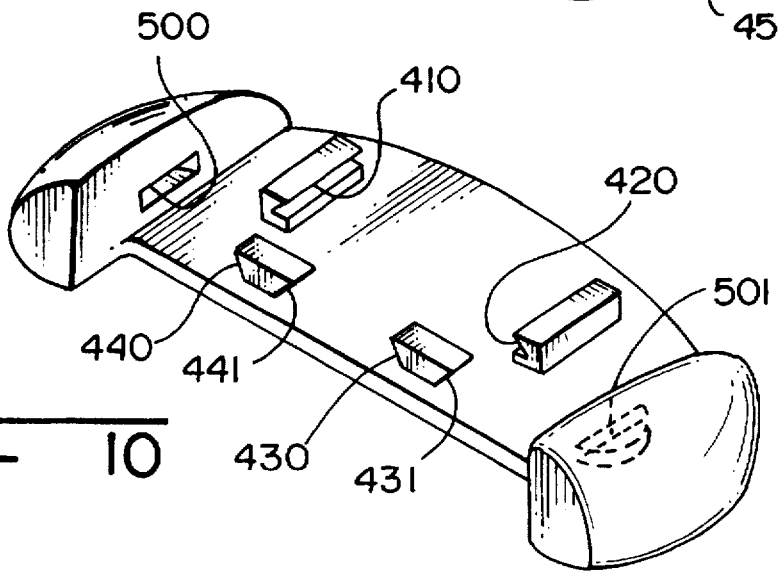
FIG. 10 shows the rough piece of FIG. 8 at a yet more advanced finishing stage before the injection of the second element.

The forging operation also leads to the formation of burrs 400 that are eliminated by cutting during the second phase (FIG. 9). In the course of this operation, retention elements 45, 46 adapted to improve the positioning and the imobilization of the element in the pouring mold during the following step are preserved. Then, the surfaces and the edges of the cavity 200 are rectified by milling to ensure a proper flatness and surface state improving the subsequent connection of the elements of the putter. The sole of the forged element comprises a plurality of raised pins 47, 48 threaded to keep the piece immobilized during the milling operation. Notches 410, 420, 430, 431, 440, 441, 500, 501 are obtained by milling in the securing elements 41, 42, 431 44 and in the surface of the cavity, for example in the internal surfaces of the wings 202, 203. The notches help to improve the binding of the elements 20, 21 between them, the material of the second element 21 filling the notches during pouring (see FIGS. 6 and 7).

Figure 11:
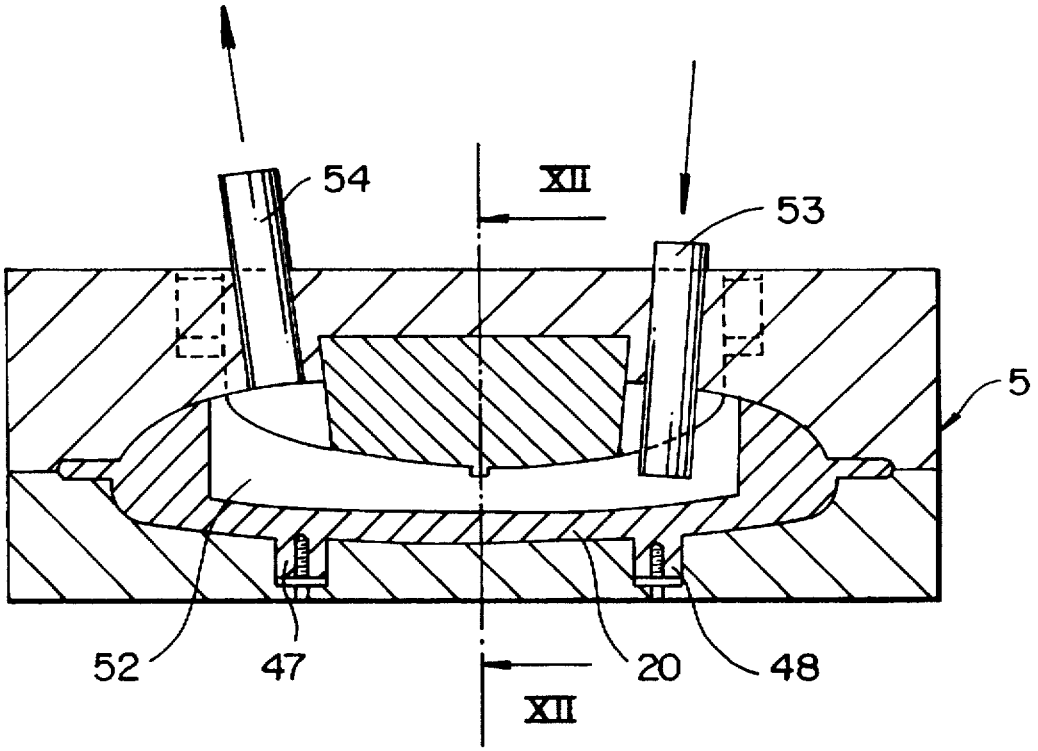
FIG. 11 is a cross-sectional view in the injection cast.
Figure 12:
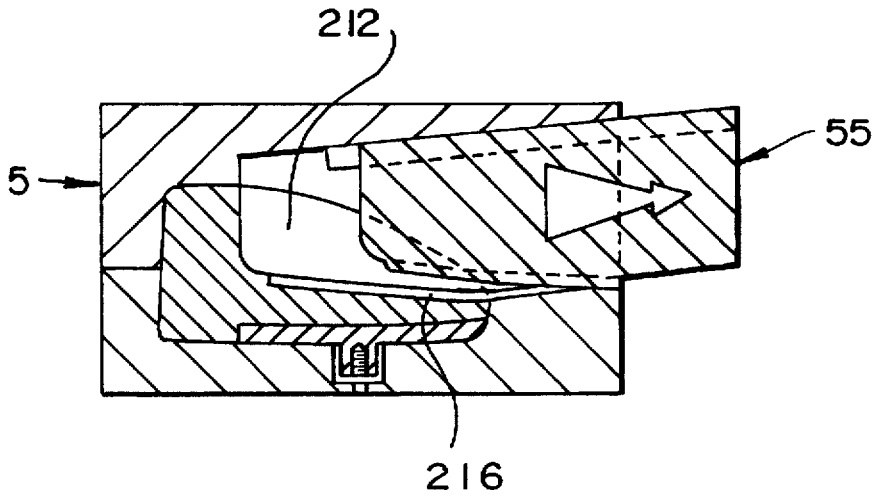
FIG. 12 is another cross-sectional view taken along line XII—XII of FIG. 11.
Figure 13:
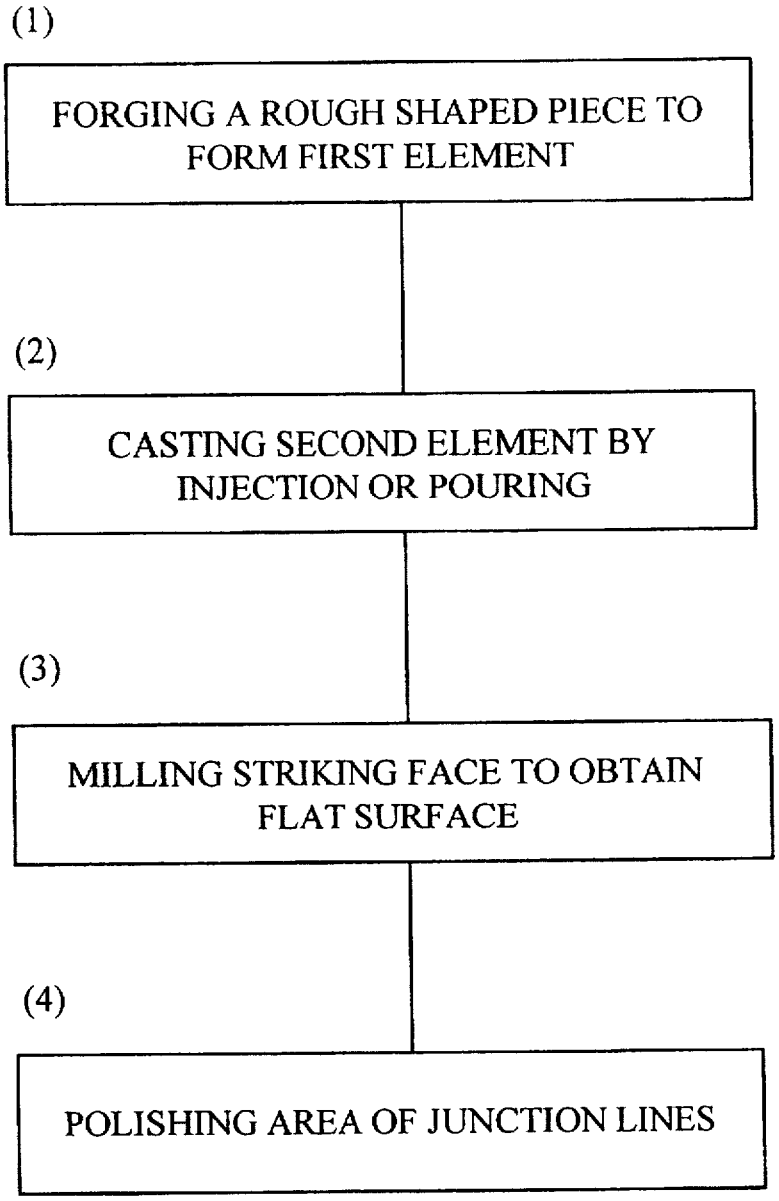
FIG. 13 schematically shows certain operations according to the method of the invention.

FIG. 11 shows the pouring step of the second element in the free space 52 between certain surfaces of the first element and the mold after the arrangement and the maintenance of the first element 20 in the injection mold 5. The injection step includes the introduction, under a high pressure, of the melting metallic material, preferably aluminum 6061, into the volume 52 provided in the mold.

The injection pressure is on the order of 150–200 tons/m$^2$ under a temperature of about 700° C. This step includes the formation of hole 12 for the shaft in its definitive shape and dimensions. For this, one provides the introduction of a shaft 53 with an appropriate diameter and length into the mold 5. The injection device can comprise two opposite shafts 53, 54: shaft 53 in an inserted position and shaft 54 in a withdrawn position, or inversely, for the construction of a right-handed head or inversely for a left-handed head (FIG. 11) No finishing operation is necessary in the hole.

Likewise, during the pouring a mold element 55 mounted on a slide is indexed in position and is withdrawn outside of the mold 5 after solidification and ejection of the head from the mold. This permits the formation of the rear recess 212 and of the alignment groove 216. This mold element 55 must have at least an angle of approximately 10° with respect to the horizontal to be able to form the recess and to be easily withdrawn.

After the opening of the mold and the ejection of the piece, one proceeds to finishing operation that includes:

a step in which one rectifies by milling of the striking surface 10 to obtain a flat surface, a cutting or emerizing/grinding with emery of the retention elements 45, 46 and pins 47, 48, and lastly, a second polishing step of the surfaces, in particular, in the area of the junction lines between the first and second elements.

Although the invention has been described with reference to particular means, materials, and embodiments, it is to be understood that the invention is not limited to the particulars expressly disclosed, but the invention extends to all equivalents within the scope of the claims that follow.

What is claimed is:

1. A method of manufacturing a golf club head of two materials, the method comprising:

forming a first part of the head comprising forging the first part from a first material, the first material being a metallic material;

positioning the first part in a mold and creating free space between surfaces of the first part and the mold;

forming a second part of the head from a second material, comprising casting by injecting or pouring the second material into the free space and creating an intimate connection between the first part and the second part;

removing the head from the mold after the second part has solidified in intimate connection with the first part; and said forming a first part comprises forming outer surfaces of a toe and a heel of the golf club head.

2. A method of manufacturing a golf club head according to claim 1, wherein:

said forming a first part comprises forming at least one surface defining an open cavity in the first part;

said injecting or pouring comprises injecting or pouring at least a portion of the second material into the open cavity.

3. A method of manufacturing a golf club head according to claim 1, wherein:

said forming a first part further comprises forming lateral end portions of a striking face of the golf club head.

4. A method of manufacturing a golf club head according to claim 1, wherein: said forming a second part comprises forming at least a central portion of a striking face of the golf club head.

5. A method of manufacturing a golf club head according to claim 4, wherein:

said forming a second part further comprises forming an outer upper central surface of the golf club head.

6. A method of manufacturing a golf club head according to claim 4, wherein:

the method further comprises, after said removing the head from the mold, finishing the head, said finishing comprises:

milling the striking face to obtain a predetermined flat surface; and polishing at least areas of junction between the first and second parts of the head.

7. A method of manufacturing a golf club head according to claim 1, wherein:

said forming a second part comprises creating a hole adapted to receive a golf club shaft during said injecting or pouring.

8. A method of manufacturing a golf club comprising manufacturing a golf club head according to claim 7, said method comprising:

affixing a golf club shaft in the hole in the second part of the head.

9. A method of manufacturing a golf club head according to claim 1, wherein:

said forming a second part comprises forming an upwardly and rearwardly open recess, said forming an upwardly and rearwardly open recess comprises:

before said injecting or pouring the second material, locating a mold element in a predetermined position on an indexed slide; and after said removing the head from the mold, removing the mold element from the mold.

10. A method of manufacturing a golf club head according to claim 1, wherein:

said forming a second part comprises forming at least a central portion of a striking face of the club head, said striking face substantially defining a plane; and said forming a second part comprises forming an upwardly and rearwardly open recess having an alignment groove extending perpendicular to a plane of a striking face of the club head.

11. A method of manufacturing a golf club head according to claim 1, wherein:

said forming a first part comprises:

forging an unfinished first part, said unfinished first part having a plurality of burrs; and forming retention elements by removing material from said burrs, said retention elements being adapted to position and retain said first part in the mold.

12. A method of manufacturing a golf club head according to claim 1, wherein:

said forming a second part comprises forming said second part from a member selected from the group consisting of aluminum and aluminum alloy.

13. A method of manufacturing a golf club head according to claim 1, wherein:

said injecting or pouring the second material into the free space comprises injecting or pouring the second material into the free space to contact the first material and thereby form with the first material an intimate and solid bond.

14. A method of manufacturing a golf club head, the method comprising:

forming a first part of the head comprising forging the first part from a first material, the first material being a metallic material;

positioning the first part in a mold and creating free space between surfaces of the first part and the mold;

forming a second part of the head from a second material, comprising casting by injecting or pouring the second material into the free space and creating an intimate connection between the first part and the second part;

removing the head from the mold after the second part has solidified in intimate connection with the first part;

wherein said forming a first part comprises forming at least one surface defining an open cavity in the first part;

said injecting or pouring comprises injecting or pouring at least a portion of the second material into the open cavity;

wherein said forming a first part further comprises forming a plurality of connection elements projecting from a surface of the open cavity, the connection elements facilitating anchoring of the first part to the second part and facilitating an intimate solid assembly between the first part and the second part.

15. A method of manufacturing a golf club head according to claim 14, wherein:

said forming a first part further comprises forming notches in said connection elements and/or in said at least one surface of said first part.

16. A method of manufacturing a golf club head, the method comprising:

forming a first part of the head comprising forging the first part from a first material, the first material being a metallic material;

positioning the first part in a mold and creating free space between surfaces of the first part and the mold;

forming a second part of the head from a second material, comprising casting by injecting or pouring the second material into the free space and creating an intimate connection between the first part and the second part;

removing the head from the mold after the second part has solidified in intimate connection with the first part;

wherein said forming a first part comprises forming a first part from a high density material to constitute a heel portion, a toe portion, and a majority of a sole surface of the golf club head.

17. A method of manufacturing a golf club head according to claim 16, wherein:

said forming a second part comprises forming the second part from a material having a density lower than the density of said high density material, said second part forming a remainder of the golf club head not formed by the first part of the head, said second part constituting at least a central portion of the striking face of the golf club head.

18. A method of manufacturing a golf club head according to claim 17, wherein:

said forming a first part comprises forming the first part to have a U-shaped cavity, said U-shaped cavity formed by a bottom constituted by the majority of the sole of the golf club head and a pair of wings extending upwardly and rearwardly from said bottom, said pair of wings being constituted by said heel portion and said toe portion; and said forming a second part comprises forming the second part to have a rearwardly extending portion and a front portion, said front portion constituting a majority of a striking face of the golf club head, said rearwardly extending portion having a shape complementary to said U-shaped cavity and being positioned in said U-shaped cavity.

19. A method of manufacturing a golf club head according to claim 18, wherein:

said forming a second part comprises forming said second part to have an upwardly and rearwardly open recess to provide for a reduction in thickness of said second material in a central portion of said golf club head.

20. A method of manufacturing a golf club head according to claim 19, wherein:

the recess is formed with a forwardly facing concave curved edge.

21. A method of manufacturing a golf club head according to claim 20, wherein:

the edge of the recess is formed to be a portion of an arc having a radius of curvature extending from an origin positioned along a line perpendicular to a plane of the striking face, the radius having a magnitude substantially equal to a magnitude of a radius of a golf hole on a green.

22. A method of manufacturing a golf club head according to claim 18, wherein:

the head is formed to be symmetrical with respect to a vertical median plane passing through a center of the striking face;

said forming a second part comprises forming a hole in a portion in the vicinity of the heel portion of the first part, the hole being adapted to receive a shaft for the golf club.

23. A method of manufacturing a golf club head, the method comprising:

forming a first part of the head comprising forging the first part from a first material, the first material being a metallic material;

positioning the first part in a mold and creating free space between surfaces of the first part and the mold;

forming a second part of the head from a second material, comprising casting by injecting or pouring the second material into the free space and creating an intimate connection between the first part and the second part;

removing the head from the mold after the second part has solidified in intimate connection with the first part;

wherein said forming a first part comprises forming said first part from a member selected from the group consisting of copper and copper alloy.

24. A method of manufacturing a head of a putter, said method comprising:

forming a first part of the head comprising forging the first part from a first material, the first material being a metallic material;

positioning the first part in a mold and creating free space between surfaces of the first part and the mold;

forming a second part of the head from a second material, comprising casting by injecting or pouring the second material into the free space and creating an intimate connection between the first part and the second part;

removing the head from the mold after the second part has solidified in intimate connection with the first part; and said forming a first part comprises forming outer surfaces of a toe and a head of the head of the putter.

* * * * *